US009885158B2

(12) United States Patent
Grimm et al.

(10) Patent No.: US 9,885,158 B2
(45) Date of Patent: Feb. 6, 2018

(54) PAVING SCREED WITH FASTENING DEVICE FOR A HEATING ELEMENT

(71) Applicant: JOSEPH VOEGELE AG, Ludwigshafen/Rhein (DE)

(72) Inventors: Frank Grimm, Edingen-Neckarhausen (DE); Thorsten Eckart, Ilvesheim (DE)

(73) Assignee: JOSEPH VOEGELE AG (DE)

( * ) Notice: Subject to any disclaimer, the term of this patent is extended or adjusted under 35 U.S.C. 154(b) by 0 days.

(21) Appl. No.: 15/584,259

(22) Filed: May 2, 2017

(65) Prior Publication Data

US 2017/0314216 A1 Nov. 2, 2017

(30) Foreign Application Priority Data

May 2, 2016 (EP) ..... 16167878

(51) Int. Cl.
*E01C 23/00* (2006.01)
*E01C 23/14* (2006.01)

(52) U.S. Cl.
CPC ..... *E01C 23/14* (2013.01)

(58) Field of Classification Search
CPC ..... E01C 23/14
USPC ..... 404/77, 79, 83, 95, 118
See application file for complete search history.

(56) References Cited

U.S. PATENT DOCUMENTS 5,417,516 A * 5/1995 Birtchet ..... E01C 19/42 219/528
6,318,928 B1 * 11/2001 Swearingen ..... E01C 19/42 404/72
6,334,735 B1 * 1/2002 Williams ..... E01C 19/48 404/79
6,421,594 B1 * 7/2002 Erasmus ..... E01C 19/48 219/528
6,963,050 B2 11/2005 Heindtel
8,113,738 B2 2/2012 Mahler et al.
8,297,875 B1 * 10/2012 Kopacz ..... E01C 19/48 404/118
8,636,442 B1 * 1/2014 Sopko, Jr. ..... E01C 19/48 404/118
9,181,662 B2 * 11/2015 Kopacz ..... E01C 19/48
9,249,544 B2 * 2/2016 Caputo ..... E01C 19/4833

FOREIGN PATENT DOCUMENTS

DE 20219641 U1 2/2003
DE 102008007307 A1 8/2009
DE 202011108347 U1 1/2012
DE 112014002758 T5 3/2016

OTHER PUBLICATIONS

European Search Report dated Nov. 2, 2016, Application No. EP 16167878.4-1604, Applicant Joseph Voegele AG, 6 Pages.

* cited by examiner

*Primary Examiner* — Raymond W Addie
(74) *Attorney, Agent, or Firm* — Brooks Kushman P.C.

(57) ABSTRACT

A paving screed for a road paver that comprises a screed plate, a heating element and a fastening device for pressing the heating element onto the screed plate. The fastening device comprises an actuating member and an elastic element. The actuating member is configured to deflect through its operation the elastic element directly or indirectly by a predetermined amount, wherein the elastic element applies a predetermined force directly or indirectly onto the heating element and biases the heating element against the screed plate.

17 Claims, 6 Drawing Sheets

PAVING SCREED WITH FASTENING DEVICE FOR A HEATING ELEMENT

CROSS-REFERENCE TO RELATED APPLICATIONS

This application claims foreign priority benefits under 35 U.S.C. § 119(a)-(d) to European patent application number EP 16 167 878.4, filed May 2, 2016, which is incorporated by reference in its entirety.

TECHNICAL FIELD

The disclosure relates to a paving screed.

BACKGROUND

Paving screeds to be applied in road pavers are known from practical use. They are used for laying road surfaces that can consist for example of bituminous asphalt. Therein, they are used for smoothening and compacting the road surface. As the road surface material is laid in a hot state, paving screeds are sometimes equipped with heating elements that heat up for example screed plates that slide over the material during installation.

As is for example known from the DE 20 219 641 U1, heating elements can be clamped against a screed plate by means of screws. This fastening method comes with the disadvantage that the heating elements might be damaged in case of too strong tightening of the screws.

SUMMARY

An object of the disclosure is to provide a paving screed that enables safe but still simple mounting of heating elements by modifications that are as structurally simple as possible.

The paving screed according to the disclosure for a road paver comprises a screed plate, a heating element and a fastening device for pressing the heating element onto the screed plate. The paving screed according to the disclosure is characterized in that the fastening device comprises an actuating member and an elastic element wherein the actuating member is configured to by its operation deflect the elastic element directly or indirectly by a predetermined amount whereby the elastic element applies a predetermined force directly or indirectly onto the heating element and biases said heating element against the screed plate. The elastic element is preferably a linear elastic element. Deflection and/or deflecting shall in particular be understood in the present application as compression or stretching of an elastic element. In general, however, any geometrical modification of the elastic element, which leads to the exercise of a force by the elastic element, shall be accounted for. Preferably, every geometrical modification of the elastic element according to the disclosure can be associated with a specific force, which is exercised by the elastic element, so that a specific geometrical modification reliably leads to the application of a force that is associated to such a modification.

The actuating member can comprise for example a thread and/or a cam. A possible example for an actuating member comprising a thread is a screw. An actuating member having a cam can for example be an eccentric lever. However, any suitable actuating member, whose operation leads to a defined geometrical displacement, is conceivable. Possible variants of the elastic element are the following ones: a spring, e.g., a coil spring, a helical spring, a spring plate, a disc spring, a bending spring a leaf spring and/or a torsion spring.

It is advantageous for the fastening device to have in addition an alignment aid that is configured to align the actuating member to an engagement location. As elastic elements can evade into undesired directions due to their elasticity and depending on the contact point of a structure acting on them, the alignment of the actuating member with an engagement location intended for this purpose can be particularly important. Depending on the design of the fastening device, the engagement location can be situated for example on the elastic element. However, it is also possible for the engagement location, to which the actuating member will be aligned by the alignment aid, to be situated on a further component, for example if the elastic element is deflected indirectly by a predetermined amount through operation of the actuating member. Any appropriate types of guidings are conceivable as alignment aids.

It is expedient for the amount by which the elastic element can be deflected by the actuating member to be limited to the predetermined amount. This way, operating errors can be avoided as there is no possibility for the elastic element to be deflected by a too large amount. For the case of the actuating member being a screw, for example the thread length is a suitable parameter to limit the amount as desired. Also the length from the beginning of the thread to the head is a suitable parameter to limit the amount by which the elastic element can be deflected by the actuating member. In case of actuating members with a cam, said cam can be formed in a way that the maximum deflection corresponds to the predetermined amount in case of any operation. It is particularly advantageous for the actuating member to be only movable in a direction that is opposite to the initial actuation direction upon achieving the predetermined amount.

It can be expedient to provide a positioning aid that is configured to arrange and/or to hold the heating element in a predetermined position. Such a positioning aid can for example be configured to guide the heating element on the screed plate when it is arranged in the position intended for this purpose and therefore to facilitate correct mounting for the operator. The positioning aid can also be configured to hold the heating element in the predetermined position and to prevent for example that it moves out of this position due to vibrations. Different click-on connections, snap-lock connections, guidings and/or end stops are possible for this purpose.

In addition, it can be advantageous for the fastening device to comprise a clamping device that transfers the force exercised through the elastic element to the heating element. This is in particular advantageous in cases where the form of the heating element and the form of the elastic element deviate from one another. The clamping device can for example be adapted to the form of the heating element or have one or multiple contact points for the elastic element or for further components actuated by said elastic element. The clamping device can for example have a clamping plate.

In a further variant, the fastening device can have a clamping device that transfers the force exercised by the elastic element to the heating element and on which a positioning aid is provided that is configured to arrange and/or to hold the heating element in a position. In this variant, the functions of the previously described clamping device and the equally previously described positioning aid are provided in one and the same component and/or in one and the same module so that their advantages are consequently combined.

It is conceivable that a clamping device positioning aid is provided, which is configured in a way so as to arrange and/or to hold the clamping device in a predetermined position. The clamping device positioning aid can have similar functionalities and/or structures as the previously described positioning aid for the heating element.

It can be advantageous if a magnetic element is provided, which is configured to mount the heating element on the screed plate by magnetic force or to arrange and/or to hold the heating element in a predetermined position. The magnetic element can for example have an electromagnet and/or a permanent magnet. Besides and/or in addition, the magnetic element can be provided as a positioning aid.

It is also conceivable to provide a hook-and-loop fastener that is configured to mount the heating element on the screed plate or to arrange and/or to hold the heating element in a predetermined position.

In a further variant, the heating element can be arranged between the screed plate and a clamping element, in particular, a clamping plate, wherein the screed plate and the clamping plate can be connected to tension springs that can be biased by the arrangement of the heating element between the clamping element and the screed plate and thereby press the heating element onto the screed plate.

The disclosure also relates to a road paver that comprises a tractor and a paving screed of the previously described type.

In addition, the disclosure also relates to a construction machine with an asphalt recycling vehicle and a paving screed of the type described before.

Fastening of heating elements on screed plates can also be based on other operating principles. It is for example possible that a heating element can be fastened on a screed plate by magnetic forces, for example applied by permanent magnets or electromagnets, without the fastening device according to the disclosure. Also, fastening without the fastening device according to the disclosure is conceivable by means of a Hook-and-loop fastener.

Also fastening types in which a heating element is disposed between the screed plate and a clamping element, e.g., a clamping plate, are possible, wherein the screed plate and the clamping element are connected to tension springs that are biased by the arrangement of the heating element between the clamping element and the screed plate and consequently press the heating element onto the screed plate. Also this fastening type can be provided without the fastening device according to the disclosure.

In the following, embodiments according to the disclosure will be explained in greater detail with reference to the attached drawings.

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
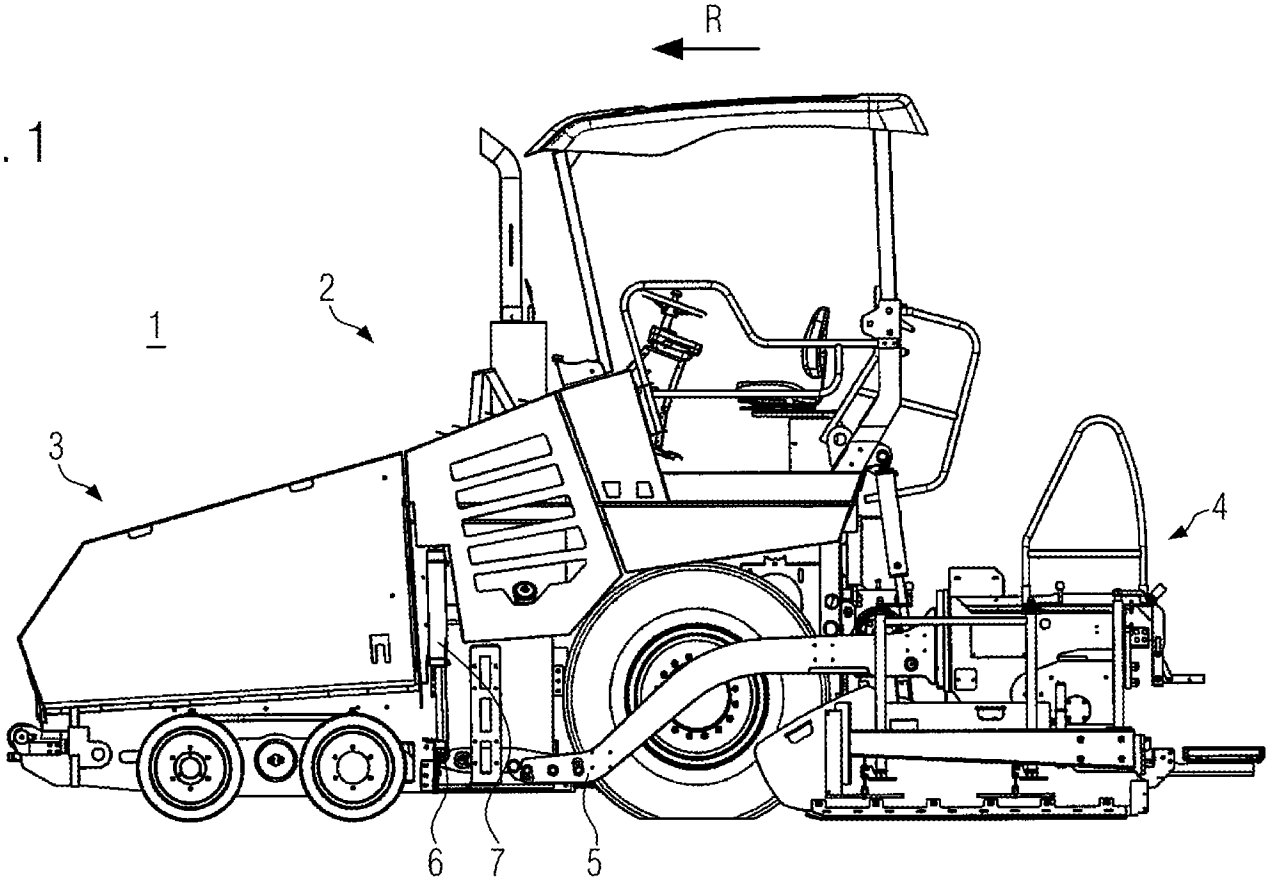
FIG. 1 shows a side view of a road paver according to the disclosure with a paving screed according to the disclosure.

FIG. 1 shows a side view of a road paver according to the disclosure. Its travel direction is indicated as R. It comprises a tractor 2. This tractor has a paving material hopper 3 in which for example asphalt paving material can be filled in. This paving material can be transported towards the rear end of the tractor 2 by means of a conveyor system (not displayed) against the travel direction R of the road paver 1. There, it can be spread out by a paving screed 4 of the road paver 1. The paving screed 4 may be mounted pivotably on the tractor 2 by means of carrier arms 5. The carrier arms 5 can be connected to the tractor 2 on tow points 6. The tow points 6 can then also be the center for the pivot movement of the carrier arms 5. The height of the tow points can be adjustable by means of an adjustment cylinder 7.

Figure 2:
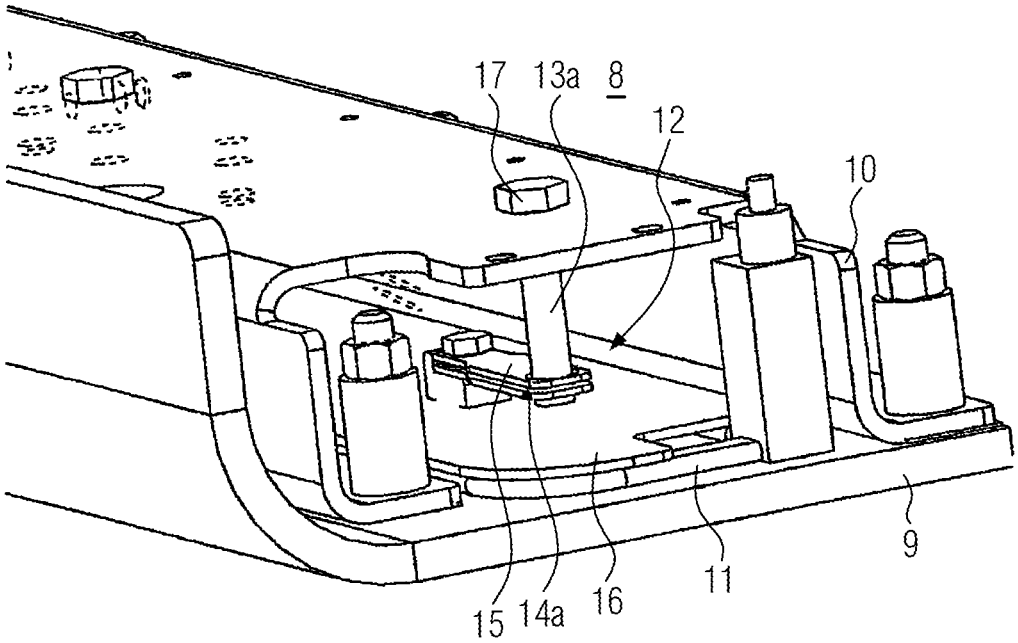
FIG. 2 shows a detail view of parts of the paving screed from FIG. 1 and in particular an embodiment of the fastening device with a clamping plate.

The paving screed 4 is used in particular, for smoothing the paving material. FIG. 2 shows a detail view of a smoothing module 8 of the paving screed 4. It may comprise a screed plate 9 that may be fastened on a frame 10. The frame 10 may be a frame of the smoothing module 8 or a structural frame of the paving screed 4. The screed plate 9 may be heatable by a heating element 11.

The heating element 11 can be pressed onto the screed plate 9 by means of a fastening device 12. In the present embodiment, the fastening device 12 comprises an actuating member 13 in form of a screw 13*a*, an elastic element 14 in form of a bending plate 14*a*, an alignment aid 15 and a clamping device 16 in form of a clamping plate 16. By operating the actuating member 13, in the present embodiment by means of screwing the screw 13*a* into a thread provided in the frame 10, the elastic element 14, i.e., the bending plate 14*a* in the present embodiment, is deflect-ed. Through the connection of the elastic element 14, i.e., of the bending plate 14 in the present embodiment, to the clamping device 16, i.e., the clamping plate 16 in the present embodiment, a force can be applied on the heating element 11 so that the heating element 11 can be biased against the screed plate 9. The fastening device 12 can thereby be designed in a way that the clamping device 16 acts onto the heating element 11 with a predetermined force. This force can be chosen in a way that a damage of all components of the smoothing unit 8 and in particular, a damage of the heating element 11 is prevented reliably whereas safe clamping of the heating element 11 is still ensured. The predetermined force that should be applied to the heating element 11 can be associated to a predetermined deflection of the elastic element 14, i.e., of the bending plate 14*a* in the present embodiment. Accordingly, the fastening device 12 can be designed in a way that this predetermined deflection is not exceeded during operation of the actuating member 13, i.e., in the present embodiment through screwing in of the screw 13*a*. In the present embodiment, for example the length of the screw 13*a* can be chosen in a way that a screw head 17 of the screw 13*a* hits the frame 10 exactly when the screw 13*a* has deflected the bending plate 14 by the predetermined amount.

Figure 3A:
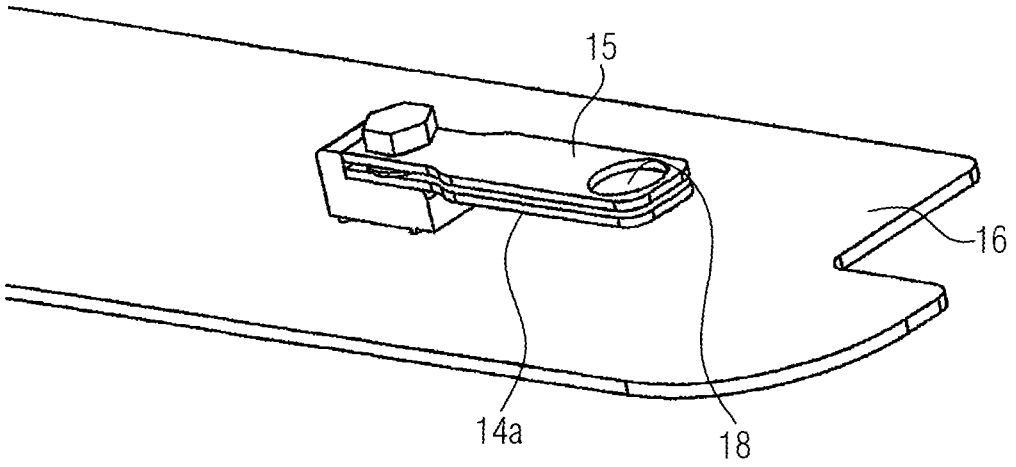
FIG. 3A shows a clamping plate from FIG. 2 with an elastic element and an alignment aid.
Figure 3B:
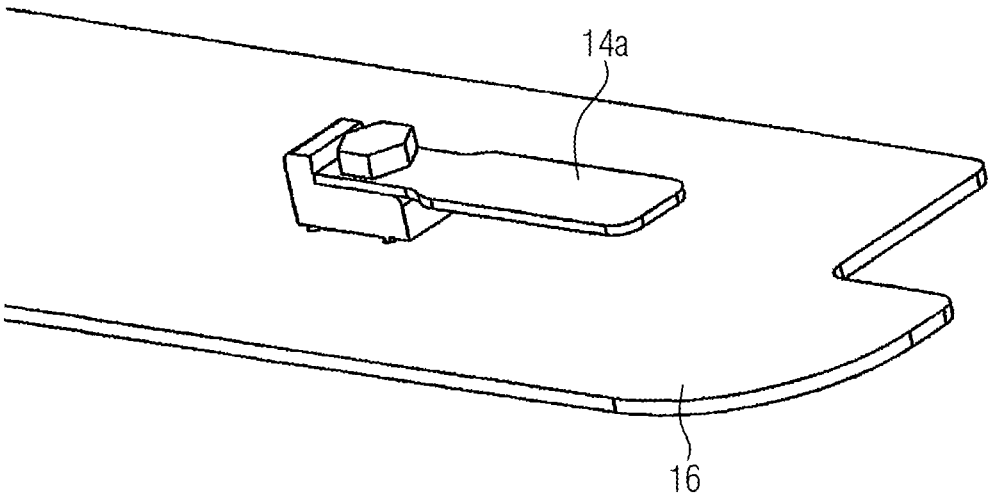
FIG. 3B shows a variant of the module shown in FIG. 3A without alignment aid.

In the embodiment shown in FIG. 2 and in FIG. 3, an alignment aid 15 is provided in addition. This alignment aid can be used to align the actuating member 13, i.e., the screw 13*a* in the present embodiment, with an engagement location 18. This way, the actuating member 13 can be prevented from slipping off of said engagement location 18. As can be seen in FIG. 3A, the engagement location 18 can be situated on the elastic element 14. However, depending on the actual design of the fastening device 12, it is also possible for the engagement location 18 to be provided on other components of the fastening device 12, e.g., on the clamping device 16. Even though such an alignment aid 15 can be advantageous, it is not necessarily required for the implementation of the disclosure. This means that the elastic element 14, i.e., the bending plate 14*a* in the present embodiment, can also be provided without the alignment aid 15. This is shown in FIG. 3B.

Figure 4:
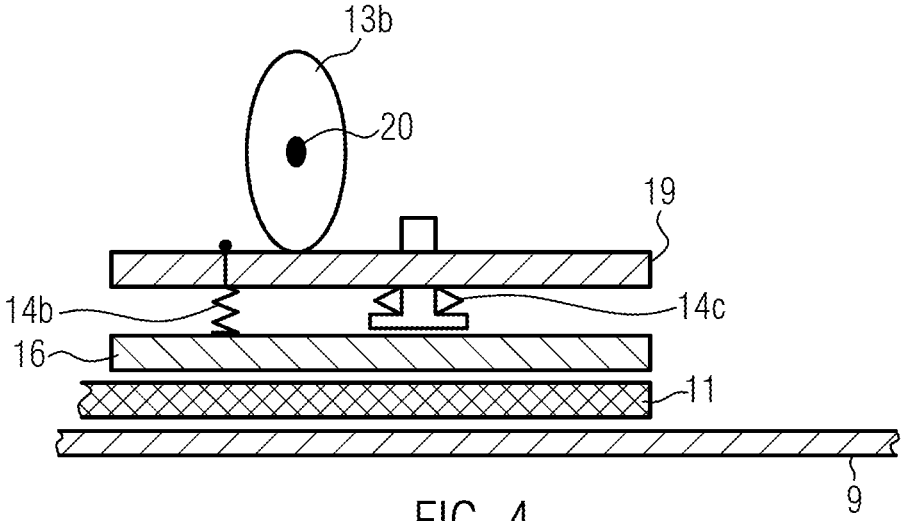
FIG. 4 shows a fastening device according to a further embodiment of the disclosure.

FIG. 4 shows a further embodiment of the fastening device 12. Here, a cam 13*b* is provided as an actuating member 13. As an example, two different elastic elements 14 are provided, i.e., a spiral or helical spring 14*b* and a disc spring stack 14*c*. However, identical elastic elements 14 are preferably provided in a uniform way in the same fastening device 12. The actuating member 13 in form of the cam 13*b* does not actuate the elastic elements 14*b* and/or 14*c* directly in the embodiment shown in FIG. 4. An intermediate member 19 is provided, which is displaced through the cam 13*b* in the present case. The intermediate member 19 is configured in a way that it can deflect several distributed elastic elements 14. This way, it can be enabled to ensure a bias on a large area while only having to operate one actuating member 13 in the process. Through the deflection of the elastic elements 14, 14*b*, 14*c*, a force is applied on the clamping device 16—also a clamping plate 16 in the embodiment from FIG. 4—whereby the heating element 11, in turn, is biased against the screed plate 9.

The cam 13*b* is shown in the present embodiment as a body with an oval cross-section that is rotatable around a rotary axis 20. Even if the boundary of the cross-section of the cam 13*b* in the present embodiment is similar to an ellipse with a major and a minor axis, oval as used previously shall be understood in the mathematical sense, i.e., as a closed convex curve, which is continuously differentiable twice, in a plane. Event this broad description, however, shall only be regarded as exemplary for the form of the cam. In the presently described example of an elliptical cross-section of the cam 13*b*, the length of the semimajor-axis of the ellipse corresponds to the predetermined amount by which the elastic elements 14, 14*b*, 14*c* should be deflected. Therefore, the deflection of the elastic elements 14, 14*b*, 14*c* is limited to this predetermined amount. In the pre-sent embodiment, the rotary axis 20 around which the cam 13*b* is rotated is perpendicular to the deflection direction of the elastic elements 14, 14*b*, 14*c*. However, it is equally possible that the rotary axis 20 is parallel to the deflection direction in any other direction.

Figure 5A:
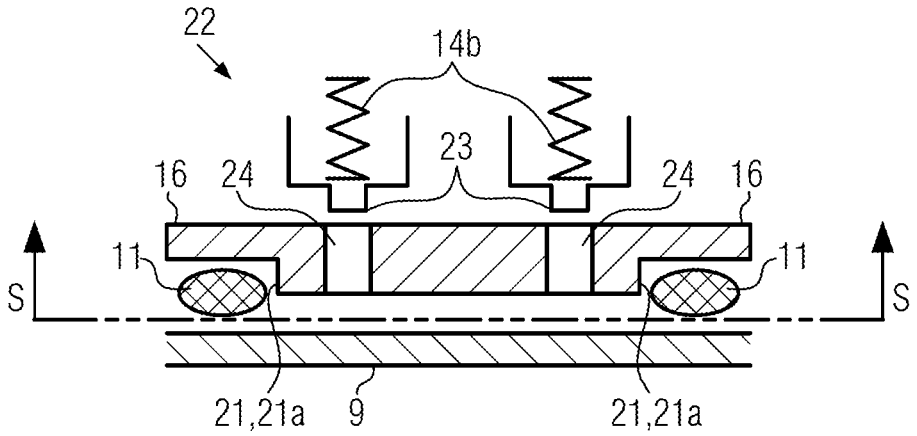
FIG. 5A shows a clamping device according to a further embodiment of the disclosure that has both a positioning aid for a heating element as well as a clamping device positioning aid.
Figure 5B:
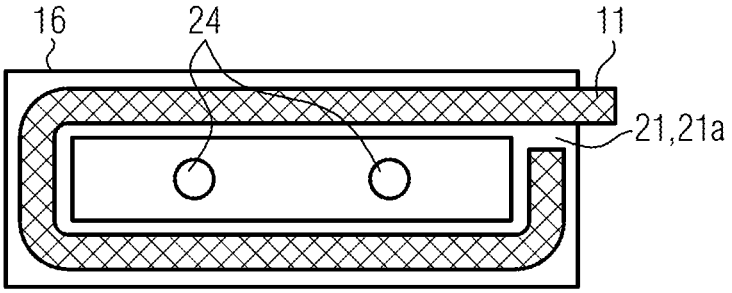
FIG. 5B shows different components from FIG. 5A in a plan view from below.

FIGS. 5A and 5B show schematic displays of a further embodiment of the fastening device 12. In particular, FIG. 5A shows a clamping device 16, a heating element 11 and a screed plate 9. A positioning aid 21 is provided on the clamping device 16. This positioning aid 21 can help with the positioning of the heating element 11. In the embodiment displayed in FIGS. 5A and 5B, the positioning aid 21 is provided as a recess 21*a* in the clamping device 16 formed as a clamping plate 16*a*. As will be described later, the positioning aid 21, however, can also be provided on other components or structures of the paving screed 4.

In addition, a clamping device positioning aid 22 is provided in FIGS. 5A and 5B. This aid has two snap-in bodies 23 in the embodiment. However, any number of snap-in bodies 23 is conceivable. The snap-in bodies 23 can be inserted in snap-in openings 24 that are provided in the clamping device 16. The snap-in bodies 23 can be spring-loaded in order to snap into the snap-in openings 24. To implement the spring load of the snap-in bodies 23, the elastic element(s) 14 can be used. However, it is also possible that separate spring elements for the sole purpose of spring loading the snap-in bodies 23 are provided. FIG. 5B shows a plan view from below—as indicated by the section line S-S- of the components from FIG. 5A. The screed plate 9 is not displayed in FIG. 5B.

Figure 6A:
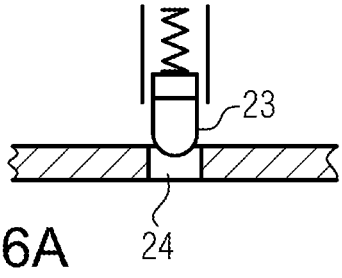
FIGS. 6A-C show different embodiments of snap-in bodies that can be used as an alignment aid and/or as a positioning aid.
Figure 6B:
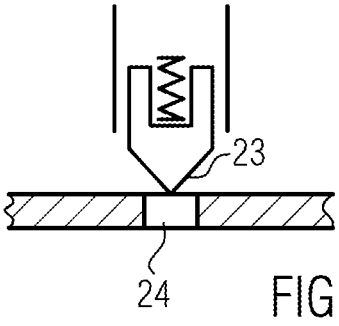
Figure 6C:
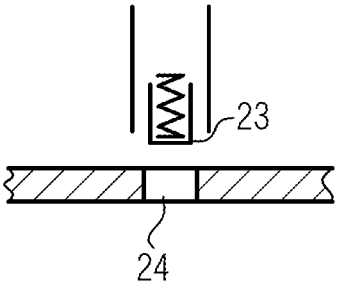

Further embodiments for snap-in bodies 23 are displayed in the FIG. 6A to 6C. As can be seen in the Figs., these embodiments can be a rounded snap-in body as shown in FIG. 6A, a pointed snap-in body 23 as shown in FIG. 6B or also a blunt snap-in body 23 as shown in FIG. 6C. The cross-section perpendicular to the deflection direction may have any form. Round cross-sections have proven to be particularly expedient. But rectangular cross-sections are equally possible. Snap-in bodies as the ones displayed in FIG. 6A to 6C and/or in FIG. 5A can be provided both as a positioning aid for the heating element 11 and as a clamping device positioning aid 22. Also an alignment aid 15 for aligning the actuating member 13 with an engagement location can comprise said snap-in bodies.

Figure 7:
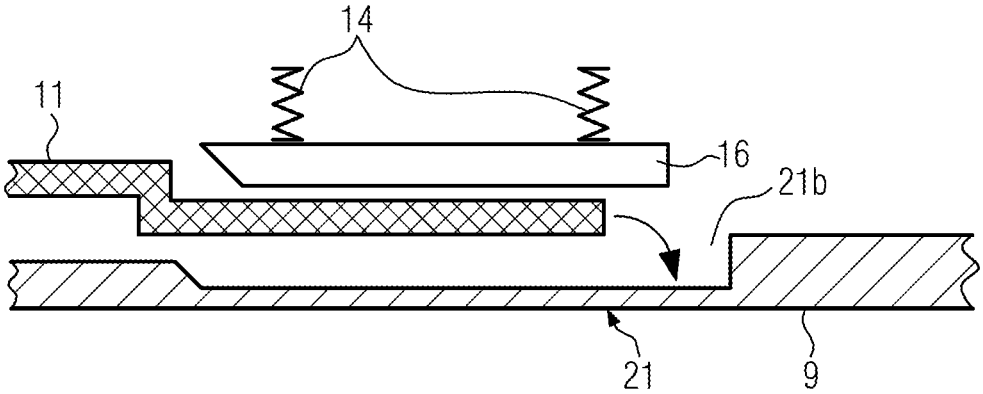
FIG. 7 shows a further embodiment of a positioning aid for a heating element.

FIG. 7 shows a further embodiment for a positioning aid 21. It displays the heating element 11, the elastic elements 14, the clamping device 16 as well as the screed plate 9. A recess 21*b* in the screed plate 9 is provided as a positioning aid 21. The heating element 11 can be inserted in said recess and biased by means of the clamping device 16 and the elastic elements 14 into this recess 21*b*. The heating element 11 can therefore be disposed and/or held in a predetermined position. The embodiment displayed in FIG. 7 thereby fulfills in particular, two functionalities, i.e., on one hand locking against undesired shifting of the heating element in relation to the screed plate 9 and on the other hand feedback to the operator who pushes the heating element 11 to the intended position to indicate that the intended position has been reached.

Figure 8:
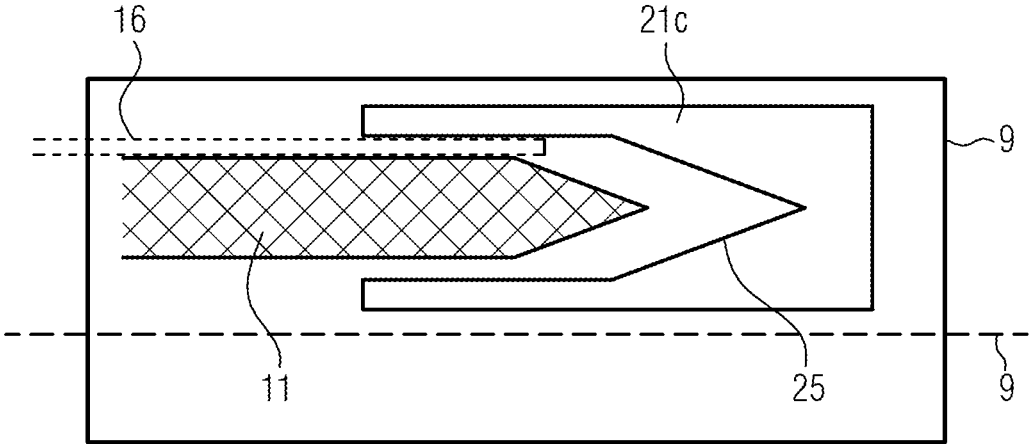
FIG. 8 shows a further embodiment of a positioning aid for a heating element and/or for a clamping device positioning aid.

FIG. 8 shows a further embodiment for a positioning aid 21. It is conceivable that the view of FIG. 8 can be a top view from above as well as a side view. Here, a two-dimensional end stop guide 21*c*, which guides the heating element 11 into a predetermined position by means of a suitably formed guiding surface 25, is provided as a positioning aid. The form of the guiding surface can thereby correspond to the external contour of the heating element 11.

The following paragraph describes the case in which FIG. 8 shows a top view from above. In this case, parts of the screed plate 9 (illustrated with continuous lines) are covered by the heating bar and the end stop guide 21*c*. The end stop guide 21*c* can be fastened on the smoothing plate 9. In this case, the positioning aid 21 can ensure correct positioning of the heating element 11 in the two directions of the plane that is parallel to the smoothing plate 9. In this example, it is possible that the clamping device 16 (not shown for this embodiment) has the same external contour as the heating element 11 in a top view from above and that the end stop guide 21 has a sufficient height to form an end stop for both the heating element 11 as well as at the same time for the clamping device 16 and to ensure this way that both are positioned congruently on top of each other.

The following paragraph, it shall be the assumed that FIG. 8 displays a side view of the end stop guide 21*c* and of the heating element 11. The arrangement of the screed plate 9 and the clamping device 16 are illustrated with dashed lines for this case. In this case, correct positioning of the heating element can be ensured in a direction that is parallel to the screed plate 9 as well as in a direction perpendicular to it.

The previously described embodiments represent different possible variants of the disclosure and of features of the disclosure. They are described in different combinations. However, the skilled reader will recognize that the disclosure is not limited to the combinations of features shown in the exemplary embodiments. Rather, all described features and embodiments of said features can be combined in any possible way. In particular, different variants of the same functionality can be substituted at random among the embodiments.

Figure 9:
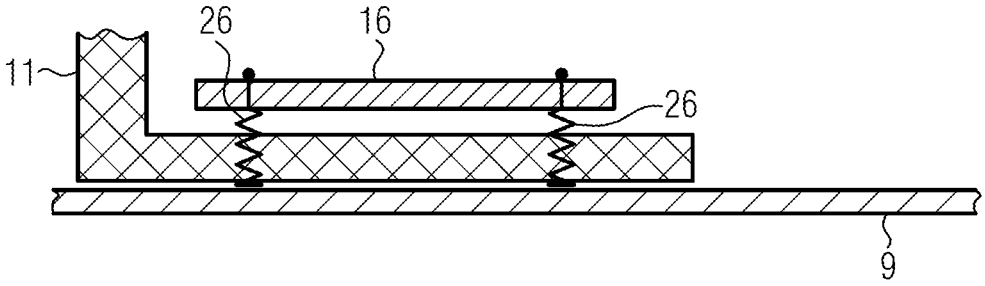
FIG. 9 shows an alternative fastening device for pressing a heating element onto a screed plate.

FIG. 9 shows an alternative structural design for biasing a heating element 11 against a screed plate 9. An actuating element is not provided here. Rather, the deflection of elastic elements 26 is ensured in this case through interaction of the heating element 11 and the clamping device 16 so that the elastic elements 26 apply a force onto the heating element 11 via the clamping device 16 wherein said force biases the heating element 11 against the screed plate 9.

While exemplary embodiments are described above, it is not intended that these embodiments describe all possible forms according to the disclosure. In that regard, the words used in the specification are words of description rather than limitation, and it is understood that various changes may be made without departing from the spirit and scope of the disclosure. Additionally, the features of various implementing embodiments may be combined to form further embodiments according to the invention.

What is claimed is:

1. A paving screed for a road paver comprising:

a screed plate;

a heating element; and a fastening device for pressing the heating element onto the screed plate, the fastening device comprising an actuating member and an elastic element, wherein the actuating member is configured to, by its operation, deflect the elastic element directly or indirectly by a predetermined amount so that the elastic element applies a predetermined force directly or indirectly on the heating element and biases the heating element against the screed plate.

2. The paving screed according to claim 1 wherein the actuating member comprises a thread and/or a cam.

3. The paving screed according to claim 1 wherein the elastic element comprises a spring, a spring plate, a helical spring, a disc spring, a bending spring, a torsion spring or a leaf spring.

4. The paving screed according to claim 1 wherein the fastening device further has an alignment aid that is configured to align the actuating member with an engagement location.

5. The paving screed according to claim 4 wherein the engagement location is provided on the elastic element.

6. The paving screed according to claim 1 wherein the amount by which the elastic element can be deflected by the actuating member is limited to the predetermined amount.

7. The paving screed according to claim 1 wherein a positioning aid is provided, which is configured to arrange and/or hold the heating element in a predetermined position.

8. The paving screed according to claim 1 wherein the fastening device comprises a clamping device configured to transfer the force applied by the elastic element to the heating element.

9. The paving screed according to claim 1 wherein the fastening device comprises a clamping device configured to transfer the force applied by the elastic element to the heating element and on which a positioning aid is provided, which is configured to arrange and/or to hold the heating element in a predetermined position.

10. The paving screed according to claim 8 further comprising a clamping device positioning aid, which is configured to arrange and/or to hold the clamping device in a predetermined position.

11. The paving screed according to claim 9 further comprising a clamping device positioning aid, which is configured to arrange and/or to hold the clamping device in a predetermined position.

12. The paving screed according to claim 1 further comprising a magnetic element, which is configured to mount the heating element on the screed plate by magnetic force or to arrange/hold the heating element in a predetermined position.

13. The paving screed according to claim 12 wherein the magnetic element has an electromagnet and/or a permanent magnet.

14. The paving screed according to claim 1 further comprising a hook-and-loop fastener, which is configured to mount the heating element on the screed plate or to arrange/hold the heating element in a predetermined position.

15. The paving screed according to claim 1 wherein the heating element is disposed between the screed plate and a clamping element, wherein the screed plate and the clamping element are connected to tension springs that are biased by arrangement of the heating element between the clamping element and the screed plate and consequently press the heating element against the screed plate.

16. A road paver comprising a tractor and a paving screed according to claim 1.

17. A construction machine comprising an asphalt recycling vehicle and a paving screed according to claim 1.

* * * * *